United States Patent [19]

Mizrachy

[11] 4,003,374

[45] Jan. 18, 1977

[54] METHODS AND APPARATUSES FOR THE PREVENTION OF VENOUS THROMBOSIS

[76] Inventor: Benjamin Mizrachy, 202 South St., Middletown, N.Y. 10940

[22] Filed: Nov. 18, 1975

[21] Appl. No.: 633,030

[52] U.S. Cl. ..... 128/48; 128/50; 128/58

[51] Int. Cl.[2] ..... A61H 7/00

[58] Field of Search ..... 128/33, 25 R, 25 B, 128/24 R, 57, 58, 303 R

[56] References Cited

UNITED STATES PATENTS

| | | | |
|---|---|---|---|
| 828,221 | 8/1906 | Langel | 128/25 B |
| 1,813,006 | 7/1931 | White et al. | 128/25 B |
| 3,128,761 | 4/1964 | Smith | 128/58 |
| 3,580,244 | 5/1971 | Graves | 128/25 B |
| 3,880,150 | 4/1975 | Vileikis | 128/57 |

*Primary Examiner*—Lawrence W. Trapp

[57] ABSTRACT

Methods and apparatuses are disclosed for reducing the risk of incurring venous thrombosis in operative, bed-ridden, and post-operative patients. The feet of a patient are dorsiflexed or otherwise "peddled" while the patient is anesthetized during surgery. This causes the calf muscles of the leg to move, which in turn prevents stasis of blood in the legs. The prevention of this stasis will reduce the risk of the patient to incur venous thrombosis.

19 Claims, 7 Drawing Figures

METHODS AND APPARATUSES FOR THE PREVENTION OF VENOUS THROMBOSIS

RELATED APPLICATION

This application is related to U.S. Pat. No. 3,853,121; issued Dec. 10, 1974; for "Methods for Reducing the Risk of Incurring Venous Thrombosis."

This invention pertains to an improved method, and apparatus to practice the subject method, for reducing the risk of incurring venous thrombosis.

The improved method of this invention is particularly concerned with dorsiflexing, or otherwise "peddling", the feet of patients while the patients are anesthetized during surgery. The dorsiflexing action imparted to the feet causes the calf muscles of the legs to move. This in turn prevents stasis of the blood in the legs, thus reducing the risk of incurring venous thrombosis.

During operations under general or spinal anesthesia the legs are completely immobile and flaccid. The usual muscle action ("muscle pump") of the legs which keeps blood moving is absent during operations. Therefore stagnation or stasis of blood in the leg veins occurs. In addition, the anesthetic agents cause vasodilatation which contributes to the "pooling" of blood in the legs. It is also possible that the clotting characteristics of the blood change as a result of some general anesthetic agents.

The important point that was not generally appreciated in the past is that the blood clot usually starts during the operation and prevention therefore must start in the operating room.

It is believed that applying a dorsiflexing stimulus to the feet, or otherwise dorsiflexing the feet of an anesthetized patient is the most useful, effective, simple, safest and least costly method of reducing the risk of incurring venous thrombosis. While massage, undulating below the legs, vibration, and intermittent compression have been previously proposed to achieve this objective, it is believed that these methods alone may not be entirely effective.

Dorsiflexion of the feet while the patient is anesthetized, would appear to be the most effective method, because it more nearly supplements the lacking muscular action in the leg. This is required to prevent stasis of the blood.

In addition, it is contemplated by this invention to further combine these other methods with dorsiflexion to provide a still greater risk of reducing method.

It is believed that active movement of the legs from the time that anesthesia is started until the time that the patient is fully ambulatory (post-operative dorsiflexion) is most desirable.

Over the past two years, an uncontrolled test was conducted by the subject inventor of this application. Dorsiflexion of the feet of many anesthetized patients during surgery was tried, with the result that not one patient developed venous thrombosis. While this test was uncontrolled, and is not proof of the effectiveness of this method, it is a dispositively significant finding from a statistical standpoint. This is so, because normally there would have been expected to be several occurrences of the thrombotic condition over this time span.

SUMMARY OF THE INVENTION

The invention relates to methods and apparatuses for providing dorsiflexion to the feet of anesthetized patients during surgery.

The legs of a patient are supported so as to allow for dorsiflexing of at least one foot of the patient, while the patient is anesthetized during surgery. The patient is then anesthetized for the purpose of performing surgery upon the patient. At least one foot of the patient is dorsiflexed so as to cause the calf muscles of the associated leg to move. This is done to prevent stasis of blood in the leg. This in turn, will reduce the risk of incurring venous thrombosis in the patient.

The apparatuses for providing the dorsiflexion to the feet comprise means for supporting at least one leg of the patient upon the operating table, while the patient is anesthetized during surgery, and means for dorsiflexing at least one foot of the patient. The dorsiflexing means may comprise an inflatable membrane, and inflatable bellows, or a pivotable rigid member, which engages with the ball of the foot. The foot is forced backwards and is then unflexed to its initial rest position.

It is an object of this invention to provide improved methods and apparatuses for reducing the risk of incurring venous thrombosis;

It is another object of the invention to provide new methods and apparatuses for dorsiflexing the feet of anesthetized patients during surgery.

These and other objects of this invention will be better understood and will become more apparent with reference to the following detailed description, taken in conjunction with the accompanying drawings, in which:

FIG. 1 is a side view of one embodiment of an inventive apparatus for dorsiflexing the feet of a patient, the feet being shown in a non-flexed position;

FIG. 1*a* is a view similar to FIG. 1 showing the feet of the patient in a flexed position;

FIG. 2 is a side view of another embodiment of the invention, with the feet of a patient being shown in a non-flexed position;

FIG. 2*a* is a view similar to FIG. 2 showing the feet of the patient in a flexed position;

FIG. 3 is a side view of an apparatus combining the methods of dorsiflexion and leg massage, the feet of a patient being shown in a non-flexed position;

FIG. 3*a* is a view similar to FIG. 3 showing the feet of the patient in a flexed position; and FIG. 4 is an internal view of the belt construction for FIGS. 3 and 3*a*.

DETAILED DESCRIPTION

Figures 1, 1A, 2, 2A, 3, 3A, 4:
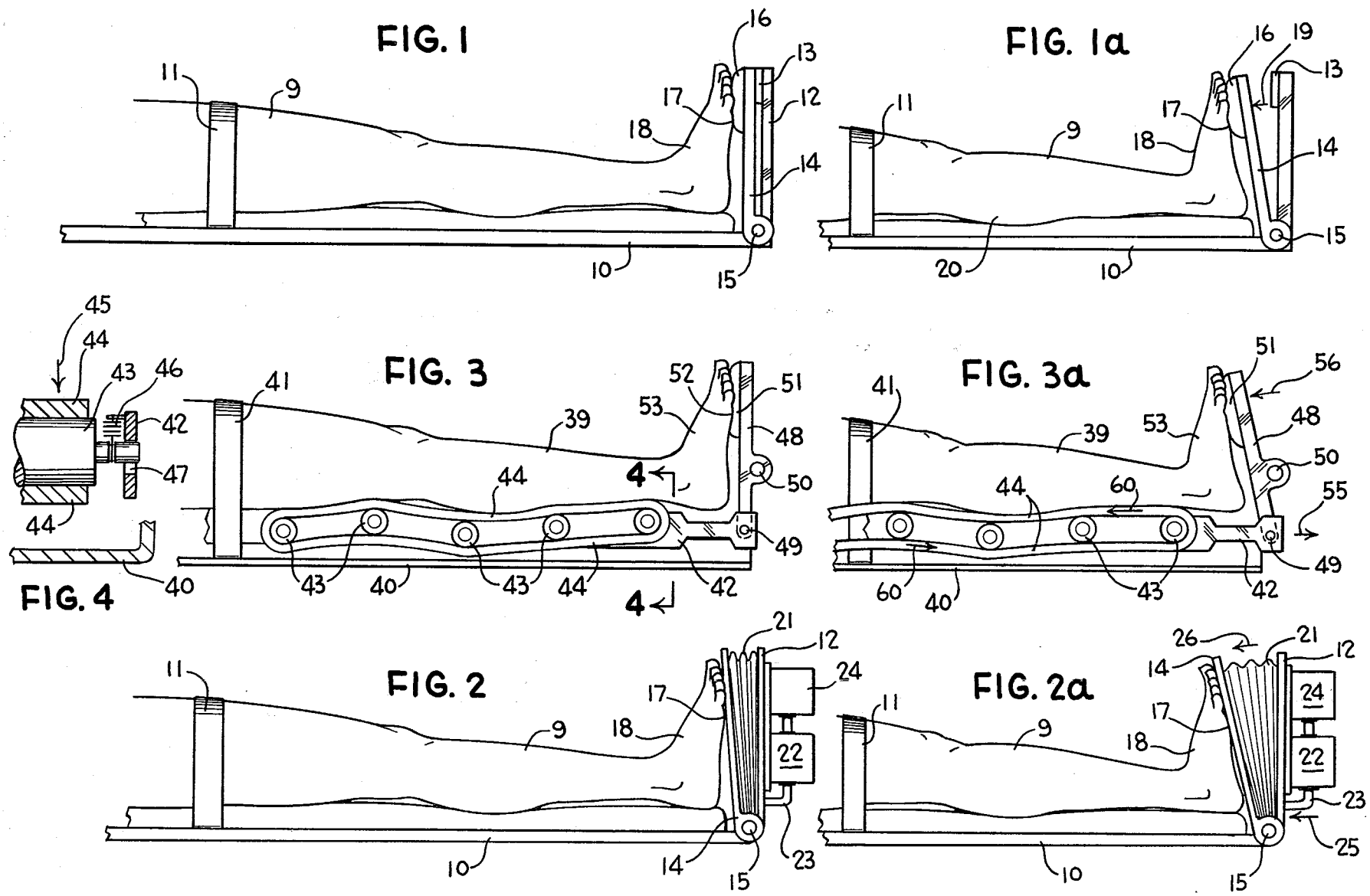

Now referring to FIG. 1, a leg 9 of a patient undergoing surgery is shown resting upon a padded frame 10. The leg 9 of the patient is secured to the frame 10 by means of a belt 11, although other appropriate means, such as an integral boot and frame member can be used.

The frame 10 is generally placed on the surgery table during an operation, but because of its portability can also be used in other applications, such as in post-operative care. In such a circumstance, the frame 10 can be placed upon a hospital bed or a diagnostic table.

On the righthand side of the leg supporting frame 10 is a vertical wall member 12. The wall member 12 is securely fastened to, or made an integral part of, frame 10. At the upper end of the wall 12 is a cushion pad 13.

A second vertical member 14 also extends from the frame 10, and is articulatively hinged thereto, at the pivot 15. The upper portion of the member 14 comprises a foot pad 16, which engages with the ball 17 of the foot 18 of leg 9.

In order to provide dorsiflexion for the foot 18 of the patient, member 14 is caused to pivot as illustrated by arrow 19 in FIG. 1*a*. When member 14 pivots, the pad 16 pushes against the ball 17 of foot 18, causing the foot to move backwardly as shown. This in turn, moves the calf muscles 20, which prevents stasis of blood in the leg 9.

After the member 14 is pivoted, it is then returned to its initial position against pad 13 as shown in FIG. 1.

The dorsiflexion can be applied to both feet of the patient, by making the frame 10, member 14, and pad 16 wide enough to accommodate both legs.

The "peddling" movement (dorsiflexion) can be intermittently applied to the patient's legs at the start of the anesthesia, through the surgery, and then post-operatively until the patient is ambulatory. The movement of member 14 can be accomplished by means of a motorized camming device, a geneva stop mechanism, a slider-crank mechanism, or other suitable intermittent type systems. The frequency of the dorsiflexion can be controlled by using a variable speed motor, and a rheostat control.

Referring to FIGS. 2 and 2*a*, another means of pivoting member 14 is shown. The numerical designations of these figures are the same as FIGS. 1 and 1*a*, where applicable. Between member 14 and the vertical wall member 12, is now connected a bellows 21.

A reversible-type pump and valving arrangement (FIG. 2) is mounted on the wall 12 as illustrated. Tubing 23 interconnects the pump to bellows 21. A control unit 24 regulates the valving of the pump and valve system 22.

When dorsiflexion is to be provided, the pump will inflate the bellows 21 as shown by the flow of air (arrow 25) through tube 23 in FIG. 2*a*. The bellows 21 will then expand (arrow 26) forcing the foot 18 to move backwardly, as depicted in FIG. 2*a*.

The member 14 is returned to its initial position in FIG. 2, by exhausting air from the bellows 21.

In practice it may be useful to combine the process of dorsiflexing the legs with other (one or more) muscle stimulating methods. For example, it may be advantageous to combine massage, vibration, intermittent compression, and other techniques with the dorsiflexion method.

FIGS. 3 and 3*a* illustrate one means of combining dorsiflexion with massage. FIG. 3 shows a leg or legs 39 which are strapped to a frame member 40 by means of a belt 41. Above the frame 40 rests two horizontal members 42 (only one member is shown in this side view). Between the two members 42 are carried a plurality of movable rollers 43. The rollers 43 are sandwiched between a flexible belt 44.

The leg or legs 39 rest on top of the rollers and belt combination. The weight and contours of the legs 39 will cause various rollers 43 to move downwardly (arrow 45) as depicted in FIG. 4. The rollers are biased against downward movement by springs 46 which are fastened to members 42. The rollers are otherwise free to move within the members 42 by means of the slots 47 in each member 42.

The members 42 are articulatively hinged on either side of a pivotable wall member 48 about hinge axis 49. Wall member 48 is pivotable about pivot 50.

A pad 51 attached to the wall member 48 contacts the ball 52 of foot 53.

When the roller carrying members 42 are pulled forward as shown by arrow 55 (FIG. 3*a*), wall member 48 is caused to pivot (arrow 56) about the pivot 50. This results in providing "peddling" (dorsiflexion) to the leg or legs 39.

Simultaneously therewith, the rollers 43 and belt 44 will be pulled forward in the direction of arrow 55, causing the rollers 43 to assume new vertical positions, and the belt 44 to undulate and circulate about the rollers 43 (arrows 60). This movement of the belt 44 and rollers 43 provides massage to the legs 39 at the same time the foot 53 is being "peddled" by member 48.

Thus, it will be evident that both dorsiflexion and massage has been combined in one motion (arrow 55) of members 42. The rollers 43 assume different vertical displacements under various portions of the legs 39, because each portion has a different contour and downward force (arrow 45 of FIG. 4) on the rollers.

Naturally any combination of methods or techniques (dorsiflexion, massage, etc.) does not have to be simultaneously combined.

Each method as well as dorsiflexing, may be separately applied in a continuous, an intermittent, a sequential, or a random manner.

Naturally many modifications and changes will obviously occur to those skilled in this art, once they have familiarized themselves with this invention. All such modifications are deemed to lie within those limits encompassed by the spirit and scope of the invention as presented by the appended claims.

What is claimed is:

1. A method of reducing the risk of incurring venous thrombosis in the legs of operative, bedridden and post-operative patients, comprising the steps of:

A. supporting the legs of the patient so as to allow for dorsiflexing of at least one foot of the patient, while the patient is anesthetized during surgery, B. anesthetizing the patient for the purpose of performing surgery upon the patient; and C. periodically dorsiflexing at least one foot of said patient while so anesthetized during surgery, so as to cause calf muscles of the associated leg to move and prevent stasis of blood in said leg, whereby the risk of incurring venous thrombosis is reduced in said patient.

2. The method of claim 1, further comprising the step of:

D. applying massage to the legs of the dorsiflexed feet of said patient while so anesthetized during surgery.

3. The method of claim 1, further comprising the step of:

D. applying vibration to the legs of said dorsiflexed feet of the patient while so anesthetized during surgery.

4. The method of claim 1, further comprising the step of:

D. applying intermittent compression to the legs of the dorsiflexed feet of said patient while so anesthetized during surgery.

5. The method of claim 1, wherein the dorsiflexion causing stimulus is intermittently applied to said feet of the patient while so anesthetized during surgery.

6. The method of claim 1, further comprising the step of:

D. applying said dorsiflexion to the feet of said post-operative patient.

7. A method of reducing the risk of incurring venous thrombosis in the legs of operative, bedridden and post-operative patients, comprising the steps of:

A. supporting the legs of the patient so as to allow for dorsiflexing of at least one foot of the patient, while the patient is anesthetized during surgery, B. anesthetizing the patient for the purpose of performing surgery upon the patient; and C. periodically dorsiflexing at least one foot of said patient while so anesthetized during surgery, so as to reduce the risk of incurring venous thrombosis in said patient.

8. The method of claim 7, further comprising the step of:

D. applying massage to the legs of the dorsiflexed feet of said patient while so anesthetized during surgery.

9. The method of claim 7, further comprising the step of:

D. applying vibration to the legs of said dorsiflexed feet of the patient while so anesthetized during surgery.

10. The method of claim 7, further comprising the step of:

D. applying intermittent compression to the legs of the dorsiflexed feet of said patient while so anesthetized during surgery.

11. The method of claim 7, wherein the dorsiflexion is intermittently applied to said feet of said patient, while so anesthetized during surgery.

12. The method of claim 7, further comprising the step of:

D. dorsiflexing the feet of said patient post-operatively.

13. An apparatus for reducing the risk of incurring venous thrombosis in the legs of operative, bedridden and post-operative patients, comprising in combination:

an operating table for performing surgery upon a patient;

means for supporting at least one leg of the patient upon said operating table, while the patient is anesthetized during surgery; and means operatively associated with the supporting means for periodically dorsiflexing at least one foot of said patient so as to reduce the risk of incurring venous thrombosis in said patient.

14. The apparatus of claim 13, wherein the dorsiflexing means comprises a bellows.

15. The apparatus of claim 13, further comprising means for restraining the legs upon the supporting means.

16. The apparatus of claim 13, wherein the dorsiflexing means comprises a pivotable member.

17. The apparatus of claim 13, further comprising leg engaging means for further stimulating the leg of the dorsiflexed foot.

18. The apparatus of claim 17, wherein said leg engaging means comprises an undulating leg support.

19. The apparatus of claim 13, wherein the dorsiflexing means comprises an inflatable membrane.

* * * * *